US008974206B2

(12) United States Patent
Lu et al.

(10) Patent No.: US 8,974,206 B2
(45) Date of Patent: Mar. 10, 2015

(54) METERING PUMP WITH SPECIAL-SHAPED CAVITY

(75) Inventors: Yang Lu, Zhejiang (CN); Hua Lei, Zhejiang (CN)

(73) Assignee: Zhejiang University, Zhejiang (CN)

( * ) Notice: Subject to any disclaimer, the term of this patent is extended or adjusted under 35 U.S.C. 154(b) by 175 days.

(21) Appl. No.: 13/384,423

(22) PCT Filed: Aug. 2, 2010

(86) PCT No.: PCT/CN2010/075633

§ 371 (c)(1), (2), (4) Date: Mar. 16, 2012

(87) PCT Pub. No.: WO2011/015123

PCT Pub. Date: Feb. 10, 2011

(65) Prior Publication Data

US 2012/0164018 A1 Jun. 28, 2012

(30) Foreign Application Priority Data

Aug. 3, 2009 (CN) ..... 2009 1 0101093

(51) Int. Cl.
*F01C 1/00* (2006.01)
*F03C 2/00* (2006.01)
(Continued)

(52) U.S. Cl.
CPC ..... *F04C 2/3441* (2013.01); *F01C 21/0845* (2013.01); *F01C 21/106* (2013.01); *F04C 15/0049* (2013.01); *F04C 2220/24* (2013.01); *F04C 2250/301* (2013.01)
USPC ..... 418/150; 418/255; 418/136; 418/137

(58) Field of Classification Search
CPC .... F04C 2/3441; F04C 2/3446; F04C 18/344; F04C 18/3441; F04C 15/0049; F04C 2220/24; F04C 2250/301; F01C 21/0809; F01C 21/0845; F01C 21/0854; F01C 21/0863
USPC ..... 418/150, 255, 259, 266–268, 136–137
See application file for complete search history.

(56) References Cited

U.S. PATENT DOCUMENTS 2,344,964 A * 3/1944 Brennan ..... 418/255
2,491,352 A * 12/1949 Zeitlin ..... 418/150

FOREIGN PATENT DOCUMENTS

CN 101149284 A * 3/2008 ..... G01F 11/44
GB 534510 A * 3/1941 ..... F04C 2/344

OTHER PUBLICATIONS

CN 101149284A, Lu Yang—Different Cavity Flowmeter—Mar. 26, 2008—English Translation.*

*Primary Examiner* — Theresa Trieu
(74) *Attorney, Agent, or Firm* — Kratz, Quintos & Hanson, LLP

(57) ABSTRACT

A metering pump with a special-shaped cavity comprising a housing, a rotor and two cover plates. The housing is a cylinder with a special-shaped surface inner cavity formed by combining two circular arc surfaces with two non-circular arc surfaces and a planar surface, an inlet and an outlet. The rotor comprises a rotor body and two pairs of combined sliding plates. The housing is matched with the cover plates for constituting a sealed cavity. When the rotor rotates, the non-circular arc surface of the special-shaped surface inner cavity can enable the two pairs of the combined sliding plates to slide in a cross manner so as to suck in fluid from the inlet and press out the fluid from the outlet. When the rotor rotates one cycle, four standard volumes are formed in a cavity body and the equal quantity of the fluid flows by the cavity body.

17 Claims, 4 Drawing Sheets

(51) Int. Cl.

| | |
|---|---|
| ***F03C 4/00*** | (2006.01) |
| ***F04C 2/00*** | (2006.01) |
| ***F04C 2/344*** | (2006.01) |
| ***F01C 21/08*** | (2006.01) |
| ***F01C 21/10*** | (2006.01) |
| ***F04C 15/00*** | (2006.01) |

METERING PUMP WITH SPECIAL-SHAPED CAVITY

TECHNICAL FIELD

The invention relates to a metering pump with a special-shaped cavity, which belongs to the field of metering technologies and fluid machinery technologies.

BACKGROUND OF THE INVENTION

Metering pumps are widely applied in chemical industry, energy, machinery, paper-making, spinning, pharmacy, water treatment and other fields, and the main types of the metering pumps comprise plunger piston metering pumps and diaphragm metering pumps.

Along with the development of the modern industrial technology, the requirements on metering accuracy, working reliability, working life, range of flow rate, adjustability of the flow rate, range of pressure, adaptability of media, corrosion resistance, high-temperature resistance, structural form, driving way, monitoring of working conditions and other aspects of the metering pumps are higher and higher, and the existing metering pumps which mainly rely on the plunger piston type and the diaphragm type cannot meet the development demands. Therefore, new structure principle design is required and the comprehensive technical performances of the metering pumps can be effectively and more economically improved.

SUMMARY OF THE INVENTION

The invention aims at providing a rotor type metering pump—metering pump with a special-shaped cavity, which is simple in structure, good in reliability and wide in range of applications.

The technical scheme adopted for solving the technical problem is as follows: the metering pump with the special-shaped cavity comprises a housing with a special-shaped surface inner cavity and an inlet and an outlet, an upper cover plate and a lower cover plate, wherein the upper cover plate and the lower cover plate are mounted on the two end surfaces of the housing, the housing, the upper cover plate and the lower cover plate constitute a sealed cavity, a rotor is mounted in the sealed cavity, and the metering pump with the special-shaped cavity is characterized in that a first combined sliding plate and a second combined sliding plate are arranged on the rotor, and two ends of each of the first combined sliding plate and the second combined sliding plate are kept in joint with the special-shaped surface inner cavity respectively; the special-shaped surface inner cavity of the housing is formed by sequentially linking a one-quarter circular arc surface AB, a one-quarter oval arc surface BC, a one-quarter circular arc surface CD, a turning transition surface DE and a position-limiting curved surface EA, and the one-quarter circular arc surface AB, the one-quarter oval arc surface BC and the one-quarter circular arc surface CD have a common axis O; the radius R of the one-quarter circular arc surface AB is equivalent to a major semi-axis a of the one-quarter oval arc surface BC, and the radius r of the one-quarter circular arc surface CD is equivalent to a minor semi-axis b of the one-quarter oval arc surface BC; the end point B of a major axis of the one-quarter oval arc surface BC is tangent to the one-quarter circular arc surface AB at the end point B for forming smooth transition; the end point C of a minor axis of the one-quarter oval arc surface BC is tangent to the one-quarter circular arc surface CD at the end point C for forming the smooth transition; the position-limiting curved surface EA is tangent to the one-quarter circular arc surface AB at the end point A for forming the smooth transition; and the turning transition surface DE is intersected with the one-quarter circular arc surface CD at the end point C and intersected with the position-limiting curved surface EA at the end point E for forming step transition from the one-quarter circular arc surface CD to the position-limiting curved surface EA. When the rotor of the metering pump rotates forward along A-B-C-D, the device can perform pumping and metering, if the rotor of the metering pump rotates reversely, when the combined sliding plates rotate to the turning transition surface DE, the combined sliding plates are blocked and cannot rotate due to the step transition in the position, and the metering pump cannot rotate reversely. When the two combined sliding plates rotate to the A point and the B point respectively, the one-quarter circular arc surface AB and the two combined sliding plates of the rotor jointly form a sealed cavity by surrounding, and the sealed cavity form a standard volume, so that the flow rate in four standard volumes can be outputted when the rotor rotates one cycle and the flow rate can be further metered.

Preferably, the length $L_{ce}$ of the line section ce of any straight line which passes the common axis O and is vertical to the common axis O and which is cut by the position-limiting curved surface EA and the one-quarter oval arc surface BC is larger than or equivalent to the sum of the radius of the one-quarter circular arc surface AB and the radius of the one-quarter circular arc surface CD.

Preferably, the distance between the D point and the E point in the turning transition surface DE is larger than or equivalent to zero. When the distance between the D point and the E point is zero, namely the D and the E are in superposition, the smooth transition from the one-quarter circular arc surface CD to the position-limiting curved surface EA is formed; and the device can be used for forward rotation and reversal rotation simultaneously and the two-way pumping can be realized.

Preferably, the distance from the common axis O is gradually increased during the transition from the E point to the A point in the position-limiting curved surface EA.

Preferably, the inlet on the housing is formed in the region of the position-limiting curved surface EA and the outlet is formed in the region of the one-quarter oval arc surface BC; and a diversion groove is formed in the region of the one-quarter oval arc surface BC in the circumferential direction, the diversion groove is started from the end point B of the major axis of the oval arc surface BC, stopped at the end point C of the minor axis of the oval arc surface BC and intersected with the outlet. Preferably, a pressure balancing groove is formed in the region of the position-limiting curved surface EA in the circumferential direction, and the pressure balancing groove is started from the inlet and stopped at the end point E of the transition surface DE. When the end part of one of the combined sliding plates turns over the B point and enters into the one-quarter oval arc surface BC, the extrusion against fluid is generated due to radian shrinkage of the special-shaped surface inner cavity, and the diversion groove needs to be arranged for leading out the fluid and preventing the pressure of the fluid to be too big in a cavity body. Simultaneously, during the process that one combined sliding plate rotates from the E point to the position of the inlet, the pressure balancing groove needs to be arranged for balancing negative pressure between the E point and the position of the inlet.

Preferably, the rotor further comprises a rotor body, the rotor body is a column body, a first guide groove and a second guide groove, which are crisscross, are radially formed on the rotor body, and the first combined sliding plate and the second combined sliding plate are arranged in the first guide groove and the second guide groove respectively in a slidable manner. The combined sliding plates can slide in the guide grooves and are kept in contact with the special-shaped surface inner cavity.

Preferably, the axial line of the rotor body is in superposition with the common axis O.

Preferably, the radius $R_1$ of the rotor body is equivalent to the radius r of the one-quarter circular arc surface CD.

Preferably, the height of each of the rotor body, the first combined sliding plate and the second combined sliding plate is consistent with that of the special-shaped surface inner cavity. The sealing performance is ensured and the inside leakage can be prevented.

Preferably, the first guide groove and the second guide groove are in centrosymmetric structures, two wings of each guide groove are incised into the rotor body by a certain depth along the radial direction of the rotor body, the incision sections are simultaneously through along the axial line of the rotor body, a radially through rectangular hole is arranged at the middle part of the first guide groove, the second guide groove is incised into the rotor body along the axial line direction of the rotor body from the upper end surface and the lower end surface of the rotor body respectively, the incision parts are simultaneously through along the radial direction of the rotor body, and the two guide grooves are mutually separated at the intersection. Therefore, the two sides of the same guide groove are intercommunicating and the interference between the two guide grooves can be avoided.

Preferably, the first combined sliding plate is formed by combining two T-shaped sliding plates in the same structure and a first elastic element, the bottom parts of the two T-shaped sliding plates are opposite to each other, the bottom parts of the two T-shaped sliding plates are connected through the first elastic element, and the bottom parts of the T-shaped sliding plates are matched with the rectangular hole at the middle part of the first guide groove; and the second combined sliding plate is formed by combining two groove-shaped sliding plates and two second elastic elements, wherein a groove is formed on one side edge of each groove-shaped sliding plate, two groove legs are formed at two ends on the groove-forming side of each groove-shaped sliding plate, the two groove-shaped sliding plates are in the same structure, the groove legs are opposite mutually and connected through the second elastic elements, and the groove legs are matched with the middle part of the second guide groove. The arrangement of the elastic elements can provide the force for supporting the sliding plates outwards so as to enable the outer sides of the sliding plates to be in joint with the special-shaped surface inner cavity.

Preferably, the length $L_1$ of the T-shaped sliding plates, the length $L_2$ of the groove-shaped sliding plates, the radius R of the one-quarter circular arc surface AB and the radius r of the one-quarter circular arc surface CD meet the relationships that $2L_1 \leq R+r$, $2L_2 \leq R+r$.

Preferably, a middle diversion hole which is vertical to the axial line of the rotor body and parallel to the second guide groove is arranged on the side wall of the rectangular hole at the middle part of the first guide groove, and the middle diversion hole can mutually communicate the parts which are positioned on the two sides of the axial line of the second guide groove; two side wing diversion holes which are vertical to the axial line of the rotor body and parallel to the first guide groove are arranged on the side walls of the upper and the lower incision sections at the middle part of the second guide groove respectively, and the side wing diversion holes can mutually communicate the parts which are positioned on the two sides of the axial line of the first guide groove; first diversion holes are arranged at the bottom parts of the T-shaped sliding plates, the distance between each first diversion hole and the outer side edge of the corresponding T-shaped sliding plate is consistent with the radius of the rotor body, the height of the first diversion holes is consistent with that of the middle diversion hole, second diversion holes are arranged at the two groove legs of each groove-shaped sliding plate respectively, the distance between each second diversion hole and the outer side edge of the corresponding groove-shaped sliding plate is consistent with the radius of the rotor body, and the heights of the two second diversion holes are consistent with the heights of the two side wing diversion holes respectively. When the two ends of the first combined sliding plate are positioned at the one-quarter circular arc surface AB section and the one-quarter circular arc surface CD section respectively, the first diversion holes are aligned with the side wing diversion holes, and the parts which are positioned on the two sides of the axial line of the second guide groove are mutually communicated so as to enable liquid in the second guide groove to be capable of flowing by through the diversion holes when the second combined sliding plate slides; on the contrary, when the two ends of the second combined sliding plate are positioned at the one-quarter circular arc surface AB section and the one-quarter circular arc surface CD section respectively, the second diversion holes are aligned with the middle diversion hole, and the parts which are positioned on the two sides of the axial line of the first guide groove are mutually communicated so as to enable the liquid in the first guide groove to be capable of flowing by through the diversion holes when the first combined sliding plate slides.

Preferably, a countersunk hole is processed on the upper end surface of the rotor body and a permanent magnet element is arranged in the countersunk hole. Magnetic signals are transmitted for calibrating rotational speed and number of turns.

Preferably, the upper cover plate adopts non-ferromagnetic material so as to avoid affecting output of the magnetic signals.

Preferably, the upper cover plate and the lower cover plate are flat plates, a first bearing hole is processed at the center of the upper cover plate, a second bearing hole is processed at the center of the lower cover plate, the first bearing hole is a through hole, the second bearing hole is a blind hole, a transmission shaft matched with the first bearing hole is arranged at the upper end of the rotor, and a centering shaft matched with the second bearing hole is arranged at the lower end of the rotor. The transmission shaft can be used for inputting power for pumping the fluid.

The detailed scheme of the invention is as follows:

As for the metering pump with the special-shaped cavity, a housing with a special-shaped surface inner cavity, an inlet, an outlet, a diversion groove and a pressure balancing groove, an upper cover plate and a lower cover plate constitute the sealed cavity, wherein the upper cover plate and the lower cover plate are mounted on the two end surfaces of the housing, and a rotor is mounted in the sealed cavity.

The special-shaped surface inner cavity of the housing is formed by sequentially linking the one-quarter circular arc surface AB, the one-quarter oval arc surface BC, the one-quarter circular arc surface CD, the turning transition surface DE and the position-limiting curved surface EA, and the one-quarter circular arc surface AB, the one-quarter oval arc surface BC and the one-quarter circular arc surface CD are coaxial. The radius R of the one-quarter circular arc surface AB is equivalent to the major semi-axis a of the one-quarter oval arc surface BC, namely R=a, and the radius r of the one-quarter circular arc surface CD is equivalent to the minor semi-axis b of the one-quarter oval arc surface BC, namely r=b. The end point B of the major axis of the one-quarter oval arc surface BC is tangent to the one-quarter circular arc surface AB at the end point B for forming the smooth transition. The end point C of the minor axis of the one-quarter oval arc surface BC is tangent to the one-quarter circular arc surface CD at the end point C for forming the smooth transition. The position-limiting curved surface EA is tangent to the one-quarter circular arc surface AB at the end point A for forming the smooth transition. The turning transition surface DE is intersected with the one-quarter circular arc surface CD at the end point C and intersected with the position-limiting curved surface EA at the end point E for forming step transition from the one-quarter circular arc surface CD to the position-limiting curved surface EA. The position-limiting curved surface EA and the one-quarter oval arc surface BC, and the one-quarter circular arc surface AB and the one-quarter circular arc surface CD meet the following relationship: the length $L_{ce}$ of the line section ce of any straight line which passes the common axis O and is vertical to the common axis O, which is cut by the position-limiting curved surface EA and the one-quarter oval arc surface BC is larger than or equivalent to the sum of the radius of the one-quarter circular arc surface AB and the radius of the one-quarter circular arc surface CD, namely $L_{ce} \geq R+r$. The inlet on the housing is formed in the region of the position-limiting curved surface EA and the outlet is formed in the region of the one-quarter oval arc surface BC. The diversion groove is formed in the region of the one-quarter oval arc surface BC, started from the end point B of the major axis of the oval arc surface BC and stopped at the end point C of the minor axis of the oval arc surface BC. The pressure balancing groove is formed in the region of the position-limiting curved surface EA, started from the inlet and stopped at the end point E of the transition surface DE.

The upper cover plate and the lower cover plate are flat plates, the first bearing hole is processed at the center of the upper cover plate, the second bearing hole is processed at the center of the lower cover plate, the first bearing hole is a through hole and the second bearing hole is a blind hole.

The rotor comprises a rotor body, a first combined sliding plate, a second combined sliding plate and permanent magnet element. The rotor body is a column body, crisscross guide grooves are processed at the middle part of the column body, a transmission shaft is coaxially processed at the upper end of the column body, and a centering shaft is coaxially processed at the lower end of the column body. The radius $R_1$ of the rotor body is equivalent to the radius r of the one-quarter circular arc surface CD, namely $R_1=r$. The height h of the rotor body is equivalent to the height H of the housing, namely h=H. The crisscross guide grooves on the rotor body comprise the first guide groove and the second guide groove, and the guide surfaces of the two guide grooves are parallel to the axial line O of the rotor body. The first guide groove and the second guide groove are centrosymmetric, the two wings of each guide groove are incised into the rotor body by the certain depth along the radial direction of the rotor body and the incision sections are simultaneously through along the axial line of the rotor body. A rectangular hole is arranged at the middle part of the first guide groove, and the rectangular hole can enable the first guide groove to be radially through along the rotor body. The second guide groove is incised into the rotor body by the certain depth along the axial line direction of the rotor body from the upper end surface and the lower end surface of the rotor body respectively, the incision parts are simultaneously through along the radial direction of the rotor body and the incision parts penetrate the rectangular hole at the middle part of the first guide groove at the root parts of the transmission shaft and the centering shaft respectively. A middle diversion hole which is vertical to the axial line O of the rotor body and parallel to the second guide groove is arranged at the middle part of the column body of the rotor body, and the middle diversion hole can mutually communicate the parts positioned on the two sides of the axial line O of the second guide groove. The two side wing diversion holes which are vertical to the axial line O of the rotor body and parallel to the first guide groove are arranged in the places which are near to the root part of the transmission shaft and near to the root part of the centering shaft of the column body of the rotor body respectively, and the side wing diversion holes can mutually communicate the parts positioned on the two sides of the axial line O of the first guide groove.

The first combined sliding plate is formed by combining two T-shaped sliding plates in the same shape and size and a first elastic element. A first diversion holes are processed at the bottom parts of the T-shaped sliding plates, which are near to the edges. The bottom parts of the two T-shaped sliding plates are opposite to each other, and the first elastic element is positioned between the bottom parts of the two T-shaped sliding plates. The second combined sliding plate is formed by combining two groove-shaped sliding plates in the identical shape and size and two second elastic elements. A second diversion hole is respectively processed at the bottom parts of the two groove legs of each groove-shaped sliding plate, which are near to the edges. The groove legs of the two groove-shaped sliding plates are opposite mutually and the two second elastic elements are positioned between the two pairs of the groove legs respectively. The thickness of the T-shaped sliding plates is equivalent to the width of the first guide groove, and the thickness of the groove-shaped sliding plates is equivalent to the width of the second guide groove. The height $h_1$ of the T-shaped sliding plates and the height $h_2$ of the groove-shaped sliding plates are equivalent to the height h of the rotor body respectively, namely $h_1=h_2=h$.

The first combined sliding plate is mounted in the first guide groove of the rotor body in the sliding fit way, and the second combined sliding plate is mounted in the second guide groove of the rotor body in the sliding fit way. The length $L_1$ of the T-shaped sliding plates, the length $L_2$ of the groove-shaped sliding plates, the radius R of the one-quarter circular arc surface AB and the radius r of the one-quarter circular arc surface CD meet the relationships that $2L_1 \leq R+r$, $2L_2 \leq R+r$. A countersunk hole is processed on the upper end surface of the rotor body and the permanent magnet element is arranged in the countersunk hole.

The rotor is in rotating fit with the first bearing hole of the upper cover plate and the second bearing hole of the lower cover plate respectively through the transmission shaft and the centering shaft on the rotor body and can rotate in the sealed cavity. Simultaneously, the rotor is in sliding fit with the one-quarter circular arc surface CD of the special-shaped surface inner cavity through the columnar surface of the rotor body, the upper end surface of the rotor body is in sliding fit with the upper cover plate, the lower end surface of the rotor body is in sliding fit with the lower cover plate, the first combined sliding plate and the second combined sliding plate are in sliding fit with the one-quarter circular arc surface AB of the special-shaped surface inner cavity, the first combined sliding plate is in sliding fit with the first guide groove and the second combined sliding plate is in sliding fit with the second guide groove so as to constitute an anti-inside leakage dynamic sealing system. When the two ends of the first combined sliding plate are positioned in the region of the one-quarter circular arc surface AB and the region of the one-quarter circular arc surface CD respectively, and the first diversion hole of the T-shaped sliding plate positioned in the region of the one-quarter circular arc surface CD and the middle diversion hole of the rotor body are just positioned in the coaxial positions so as to communicate the two sides of the second guide groove. At this time, the end part of the groove-shaped sliding plate positioned in the region of the position-limiting curved surface EA of the second combined sliding plate is kept in contact with the position-limiting curved surface EA under the action of thrust of the second elastic elements. When the two ends of the second combined sliding plate are positioned in the region of the one-quarter circular arc surface AB and the region of the one-quarter circular arc surface CD respectively, the second diversion hole of the groove-shaped sliding plate positioned in the region of the one-quarter circular arc surface CD and the side wing diversion hole of the rotor body are just positioned in the coaxial positions so as to communicate the two sides of the first guide groove. At this time, the end part of the T-shaped sliding plate positioned in the region of the position-limiting curved surface EA of the first combined sliding plate is kept in contact with the position-limiting curved surface EA under the action of the thrust of the first elastic element.

When the metering pump with the special-shaped cavity is in operation working state, the rotor can rotate according to the A→B→C→D direction by external rotation force couple through the transmission shaft. When the rotor rotates, the one-quarter oval arc surface BC of the special-shaped surface inner cavity can push the first combined sliding plate and the second combined sliding plate to slide crisscross so as to suck in the fluid from the inlet and press out the fluid from the outlet. Four standard volumes $V_0$ can be continuously formed in the AB spatial region in the sealed cavity when the rotor rotates every one cycle. Therefore, when the rotor rotates every one cycle, the equal quantity of the fluid flows by the sealed cavity. The permanent magnet element is utilized for emitting a signal of number N of rotation cycles of the rotor to the outside of the sealed cavity, thereby being capable of realizing the metering of the flow rate. The volume flow rate V of the fluid conveyed by the metering pump with the special-shaped cavity is calculated according to the following formula:

$$V=4NV_0.$$

When the metering pump with the special-shaped cavity is in non-operation (stationary) working state, if the pressure of the fluid on the outlet side is larger than the pressure of the fluid on the inlet side, the rotor is in the trend of reversion, then the T-shaped sliding plate or the groove-shaped sliding plate which is positioned in the position-limiting curved surface EA and kept in contact with the position-limiting curved surface EA can be blocked by the turning transition surface DE and the rotor cannot perform reversion.

The metering pump with the special-shaped cavity is mainly characterized in that: (1) the rotor type structure is adopted for realizing the pumping of the fluid, and the metering of the volume flow rate of the fluid can be simultaneously realized by matching the special-shaped surface cavity body with the rotor; (2) the number of parts is small and the structure is simple; (3) as the rotor is arranged in the sealed cavity and matched with the special-shaped surface cavity body for forming a dynamic sealing mechanism, the metering pump with the special-shaped cavity has the self-sucking capability, the pressure increment of the fluid is great and the pumping efficiency is high; (4) the special-shaped surface cavity body and the rotor with the crisscross combined sliding plates are matched for working, the standard volume way is used for metering the flow rate of the fluid, and the inside leakage of the fluid can be simultaneously limited through the proper dynamic sealing design, so that the metering precision of a volume type flowmeter can be achieved; (5) the elastic elements can enable the length of the combined sliding plates to be variable, so that the rotor has the abrasion automatic compensation ability and a certain anti-sticking ability; as for the two characteristics, the former is conductive to enabling the metering pump to keep the stability in the metering precision, and the later can enable the metering pump to have better safety; (6) the rotor has the property of being incapable of performing the reversion, and the rotor is matched with the cavity body for enabling the sealed cavity to have the static state internal sealing ability, thereby being particularly applicable to application occasions where the pressure at the outlet to be higher than the pressure at the inlet; (7) the two ways, namely the way of transmitting magnetic pulses by the permanent magnet element and the way of mechanically outputting the number of the rotation cycles of the rotor by the transmission shaft, are adopted for metering the flow rate and the rotational speed of the rotor, thereby being convenient to configure a closed-loop control system to flexibly regulate the flow rate and being suitable for digitized and networked applications; (8) a rotor type driving mechanism and the volume type flow rate metering way can enable the metering pump with the special-shaped cavity to be suitable for the wider range of the flow rate, the pressure and the viscosity and realize light pulsation; and (9) the structure is simple, the metering pump with the special-shaped cavity is reliable in working and easy to maintain, and the production cost is also lower.

DETAILED DESCRIPTION OF THE INVENTION

Figure 1:
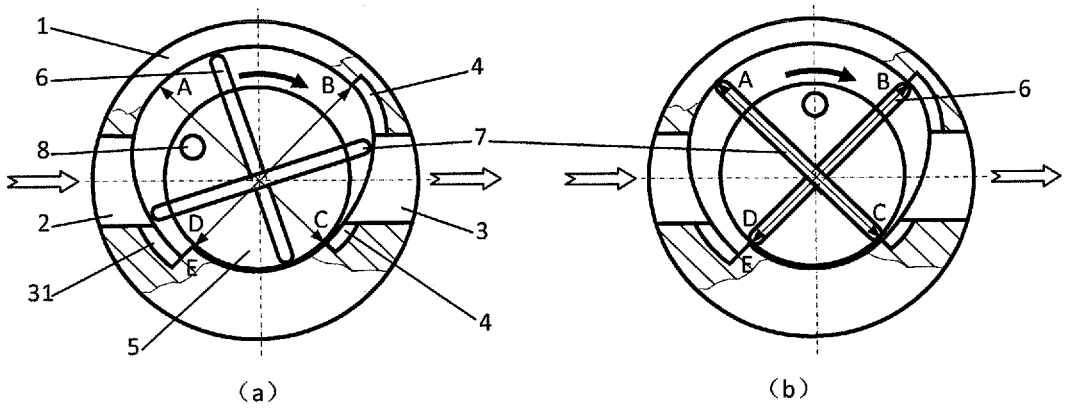
FIG. 1 is a schematic diagram of structure and working principle of metering pump with special-shaped cavity, wherein (a) diagram is a schematic diagram of rotor in any rotation position, and (b) diagram is a schematic diagram of the rotor in the rotation position for forming standard volume.

In combination of the embodiments and the figures, the invention is further described as follows.

Embodiment 1: a metering pump with a special-shaped cavity, referring to FIG. 1 to FIG. 8. As for the device, a housing 1 with a special-shaped surface inner cavity, an inlet 2, an outlet 3, a diversion groove 4 and a pressure balancing groove (31), an upper cover plate 12 and a lower cover plate 22 constitute a sealed cavity, wherein the upper cover plate 12 and the lower cover plate 22 are mounted on the two end surfaces of the housing 1, and a rotor is mounted in the sealed cavity.

Figure 2:
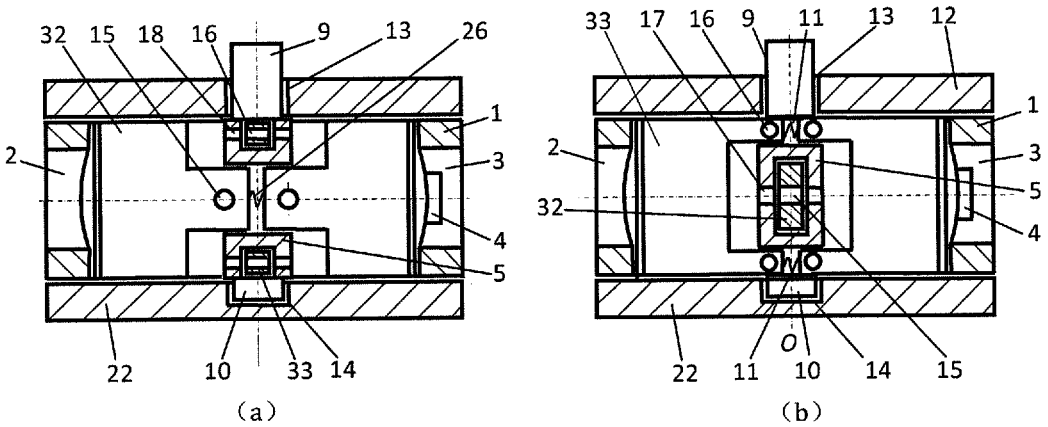
FIG. 2 is a longitudinal section diagram of metering pump with special-shaped cavity, wherein (a) diagram is a schematic diagram of the first combined sliding plate 6 located in the inlet and outlet position, and the second diversion hole 16 located in the position which is coaxial with the side wing diversion hole 18, and (b) diagram is a schematic diagram of the second combined sliding plate 7 located in the inlet and outlet position, and the first diversion hole 15 located in the position which is coaxial with the middle diversion hole 17.
Figure 3:
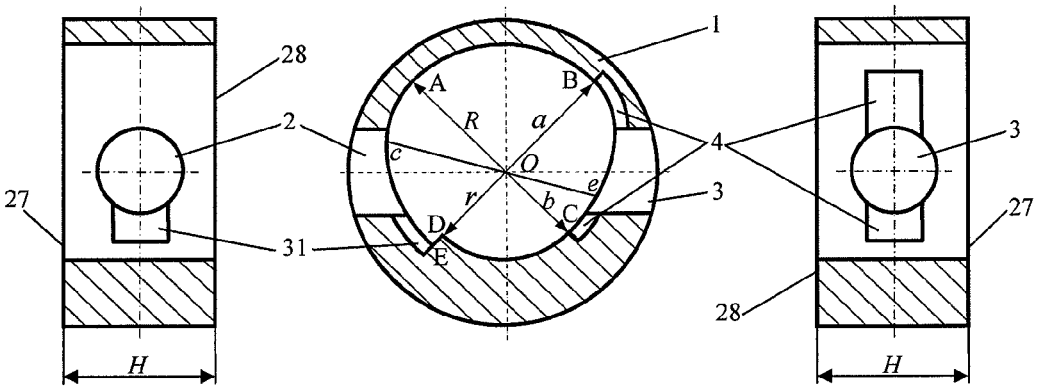
FIG. 3 is a schematic diagram of structure of housing, wherein (a) diagram is a main view of the housing, (b) diagram is a right view of the housing and (c) diagram is a left view of the housing.
Figure 4:
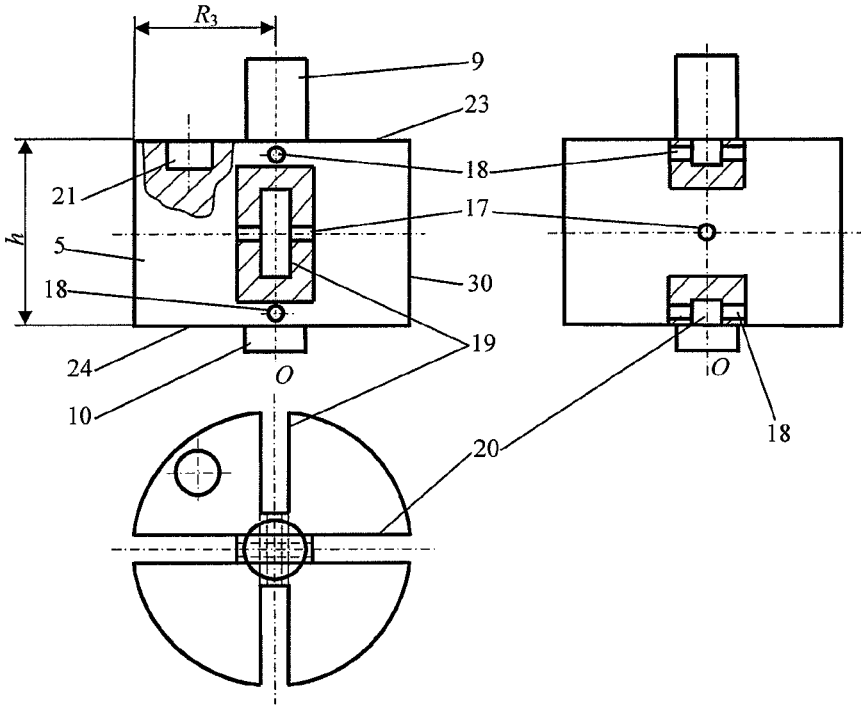
FIG. 4 is a schematic diagram of structure of rotor body, wherein (a) diagram is a main view of the rotor body, (b) diagram is a left view of the rotor body and (c) diagram is a top view of the rotor body.
Figure 5:
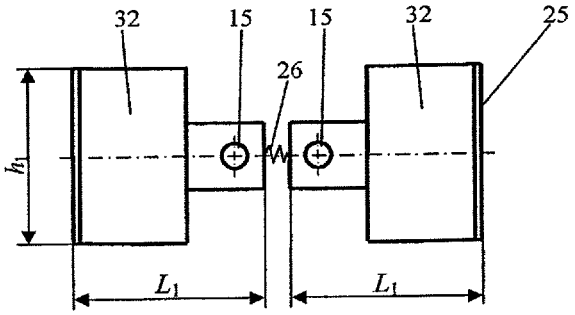
FIG. 5 is a schematic diagram of combined sliding plate constituted by two T-shaped sliding plates and elastic elements.
Figure 6:
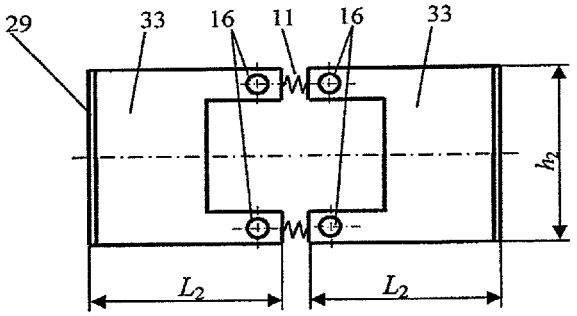
FIG. 6 is a schematic diagram of combined sliding plate constituted by two groove-shaped sliding plates and elastic elements.

The special-shaped surface inner cavity of the housing 1 is formed by sequentially linking a one-quarter circular arc surface AB, a one-quarter oval arc surface BC, a one-quarter circular arc surface CD, a turning transition surface DE and a position-limiting curved surface EA, wherein the one-quarter circular arc surface AB, the one-quarter oval arc surface BC and the one-quarter circular arc surface CD are coaxial and a common axis is O (see FIG. 2 and FIG. 3).

The radius R of the one-quarter circular arc surface AB shall be equivalent to the length of a major semi-axis a of the one-quarter oval arc surface BC, namely R=a. The radius r of the one-quarter circular arc surface CD shall be equivalent to the length of a minor semi-axis b of the one-quarter oval arc surface BC, namely r=b. The end point B of a major axis of the one-quarter oval arc surface BC shall be tangent to the one-quarter circular arc surface AB at the end point B for forming smooth transition. The end point C of a minor axis of the one-quarter oval arc surface BC shall be tangent to the one-quarter circular arc surface CD at the end point C for forming the smooth transition. The position-limiting curved surface EA shall be tangent to the one-quarter circular arc surface AB at the end point A for forming the smooth transition. The turning transition surface DE shall be intersected with the one-quarter circular arc surface CD at the end point C and intersected with the position-limiting curved surface EA at the end point E for forming step transition from the one-quarter circular arc surface CD to the position-limiting curved surface EA. The function of the turning transition surface DE is to prevent reversion of the rotor, the length of the turning transition surface DE is not suitable for being too long, and the length of turning transition surface DE only needs to be sufficient to reliably block the sliding plates. If the reversion of the rotor does not need to be prevented, the turning transition surface DE can be removed, which is equivalent to the situation of enabling the length of the turning transition surface DE to be zero, namely the point D and the point E are superposed into one point. Not matter whether the turning transition surface DE is arranged or not, the position-limiting curved surface EA is designed according to the following conditions:

The length $L_{ce}$ of the line section ce of any straight line which passes the common axis O and is vertical to the common axis O, which is cut by the position-limiting curved surface EA and the one-quarter oval arc surface BC is larger than or equivalent to the sum of the radius of the one-quarter circular arc surface AB and the radius of the one-quarter circular arc surface CD, namely $L_{ce} \geq R+r=a+b$.

Figure 7:
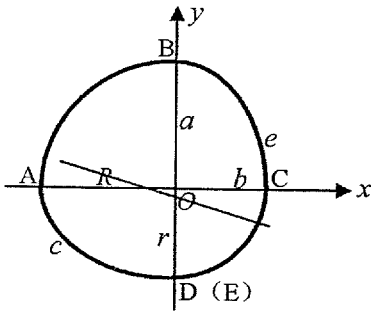
FIG. 7 is a schematic diagram of minimal position-limiting curved surface.
Figure 8:
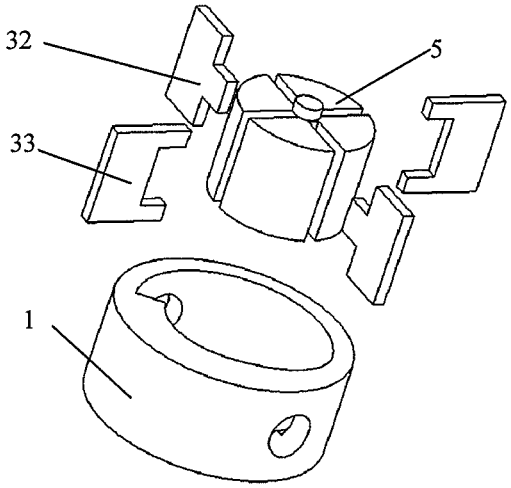
FIG. 8 is a decomposition diagram of housing and rotor.

Under the situation that the transition surface DE is not arranged, the position-limiting curved surface EA can be represented by DA, referring to FIG. 7. If the position-limiting curved surface DA is designed according to the condition that $L_{ce}=R+r$, the equation of the position-limiting curved surface DA is as follows:

$$\sqrt{\frac{a^2b^2x^2}{a^2y^2+b^2y^2}-\frac{b^4x^2}{a^2y^2+b^2y^2}+b^2}+\sqrt{x^2+y^2}-(a+b)=0.$$

The inlet 2 on the housing 1 is formed in the region of the position-limiting curved surface EA, the outlet 3 is formed in the region of the one-quarter oval arc surface BC and the two are coaxial under general situations. The diversion groove 4 is formed in the region of the one-quarter oval arc surface BC, started from the end point B of the major axis and stopped at the end point C of the minor axis. The function of the diversion groove 4 is to timely reduce the pressure of fluid at the outlet. The pressure balancing groove 31 is formed in the region of the position-limiting curved surface EA, started from the inlet 2 and stopped at the end point E of the transition surface DE. The function of the pressure balancing groove 31 is to release negative pressure in a negative pressure region formed between the front part of the T-shaped sliding plate 32 or the groove-shaped sliding plate 33 and the transition surface DE during the rotation process of the rotor. In order to connect an upstream pipeline with a downstream pipeline, the inlet 2 and the outlet 3 shall be processed with connecting structures, such as pipeline threads. The upper end surface and the lower end surface of the housing are smooth planes, and the two are parallel to each other and vertical to the common axis O of all the arc surfaces of the special-shaped surface inner cavity. The material, such as cast iron, cast steel, stainless steel, copper alloy and the like, for manufacturing the housing 1 shall be selected according to the characters of working medium, working condition parameters and other technical requirements, and stainless steel is selected in the embodiment.

The upper cover plate 12 and the lower cover plate 22 are flat plates, and the planeness of the upper cover plate 12 and the lower cover plate 22 shall be matched with the upper end surface 27 and the lower end surface 28 of the housing 1, thereby being capable of forming a sealed structure with the upper end surface 27 and the lower end surface 28 of the housing 1 by relying on plane fitting. A first bearing hole 13 is processed at the center of the upper cover plate 12, a second bearing hole 14 is processed at the center of the lower cover plate 22, the first bearing hole 13 is a through hole and the second bearing hole 14 is a blind hole. The material of the two cover plates can be the same with the material of the housing 1. When a permanent magnet is adopted as a metering signal transmitting device, the material for manufacturing the upper cover plate 12 and the lower cover plate 22 needs to consider the characters of the working medium, the working condition parameters and other factors and also needs to meet the requirement on magnetic flux, so that non-ferromagnetic material shall be used, such as stainless steel, copper alloy, aluminum alloy and the like, and stainless steel is selected in the embodiment.

The rotor comprises a rotor body 5, a first combined sliding plate, a second combined sliding plate and a permanent magnet element 8. The rotor body 5 is a column body, crisscross guide grooves are processed at the middle part of the column body, a transmission shaft 9 is coaxially processed at the upper end of the column body, and a centering shaft 10 is coaxially processed at the lower end of the column body. The radius $R_1$ of the rotor body 5 is equivalent to the radius r of the one-quarter circular arc surface CD, namely $R_1=r$. The height h of the rotor body 5 is equivalent to the height H of the housing 1, namely h=H. The crisscross guide grooves on the rotor body 5 comprise a first guide groove 19 and a second guide groove 20, and the guide surfaces of the two guide grooves are parallel to the axial line O of the rotor body 5. The first guide groove 19 and the second guide groove 20 are centrosymmetric, two wings of each guide groove are incised into the rotor body 5 by a certain depth along the radial direction of the rotor body 5 and the incision sections are simultaneously through along the axial line of the rotor body 5. A rectangular hole is arranged at the middle part of the first guide groove 19, and the rectangular hole can enable the first guide groove 19 to be radially through along the rotor body 5. The second guide groove 20 is incised into the rotor body 5 by the certain depth along the axial line direction of the rotor body 5 from the upper end surface 23 and the lower end surface 24 of the rotor body 5 respectively, the incision parts are simultaneously through along the radial direction of the rotor body 5 and the incision parts penetrate the rectangular hole at the middle part of the first guide groove 19 at the root parts of the transmission shaft 9 and the centering shaft 10 respectively. A middle diversion hole 17 which is vertical to the axial line O of the rotor body 5 and parallel to the second guide groove 20 is arranged at the middle part of the column body of the rotor body 5, and the middle diversion hole 17 can mutually communicate the parts positioned on the two sides of the axial line of the second guide groove 20. Two side wing diversion holes 18 which are vertical to the axial line O of the rotor body 5 and parallel to the first guide groove 19 are arranged in the places which are near to the root part of the transmission shaft 9 and near to the root part of the centering shaft 10 of the column body of the rotor body 5 respectively, and the side wing diversion holes 18 can mutually communicate the parts positioned on the two sides of the axial line O of the first guide groove 19. A countersunk hole 21 is processed on the upper end surface 23 of the rotor body 5 and the permanent magnet element 8 is arranged in the countersunk hole 21. The permanent magnet element 8 can be a columnar magnetic steel standard part, and the assembly way can be pressing the element in the countersunk hole 21 in interference fit manner. The material, such as stainless steel, copper alloy and the like, for manufacturing the rotor 5 shall be determined according to the characters of the working medium, the working condition parameters and other factors, and stainless steel is selected in the embodiment.

A first combined sliding plate is formed by combining two T-shaped sliding plates 32 in the same shape and size and a first elastic element 26. A circular arc surface whose radius is smaller than $R_1$ is arranged at the top part 25 of each T-shaped sliding plate 32, or the arc surface can be also designed into other shapes, and a first diversion hole 15 is processed at the bottom part of each T-shaped sliding plate 32, which is near to the edge. In order mount the first elastic element 26, an accommodating hole can be respectively processed on the edges at the bottom parts of the T-shaped sliding plates 32. Under the working state, the bottom parts of the two T-shaped sliding plates are opposite to each other and the first elastic element 26 is positioned between the bottom parts of the two T-shaped sliding plates so as to enable the two T-shaped sliding plates to generate mutual thrust. A second combined sliding plate is formed by combining two groove-shaped sliding plates 33 in identical shape and size and two second elastic elements 11. A circular arc surface whose radius is smaller than $R_1$ is arranged at the top part 29 of each groove-shaped sliding plate 33, or the arc surface can be also designed into other shapes, and a second diversion hole 16 is respectively processed at the bottom part of each groove leg, which is near to the edge. In order mount the second elastic elements 11, an accommodating hole can be respectively processed on the edges at the bottom parts of the two groove legs of each groove-shaped sliding plate 33. Under the working state, the groove legs of the two groove-shaped sliding plates are opposite mutually and the two second elastic elements 11 are positioned between the two pairs of the groove legs respectively so as to enable the two groove-shaped sliding plates to generate the mutual thrust. The thickness of the T-shaped sliding plates 32 shall be equivalent to the width of the first guide groove 19, and the thickness of the groove-shaped sliding plates 33 shall be equivalent to the width of the second guide groove 20. The height $h_1$ of the T-shaped sliding plates 32 and the height $h_2$ of the groove-shaped sliding plates 33 shall be equivalent to the height h of the rotor body 5 respectively, namely $h_1=h_2=h$. The first combined sliding plate is mounted in the first guide groove 19 of the rotor body 5 in the sliding fit way, and the second combined sliding plate is mounted in the second guide groove 20 of the rotor body 5 in the sliding fit way. The length $L_1$ of the T-shaped sliding plates 32, the length $L_2$ of the groove-shaped sliding plates 33, the radius R of the one-quarter circular arc surface AB and the radius r of the one-quarter circular arc surface CD shall meet the following relationships:

$$2L_1 \leq R+r;$$

$$2L_2 \leq R+r.$$

The material, such as stainless steel, copper alloy and the like, for manufacturing the T-shaped sliding plates 32 and the groove-shaped sliding plates 33 shall be take into unified consideration of the rotor body 5 and the housing. The material, such as stainless steel, copper alloy, elastic plastic and the like, for manufacturing the first elastic element 26 and the second elastic elements 11, is mainly determined according to the characters of the working medium, the working condition parameters, working life and other factors, and stainless steel is selected in the embodiment.

The rotor is in rotating fit with the first bearing hole 13 of the upper cover plate 12 and the second bearing hole 14 of the lower cover plate 22 respectively through the transmission shaft 9 and the centering shaft 10 on the rotor body 5 and can rotate in the sealed cavity. Simultaneously, the rotor is in sliding fit with the one-quarter circular arc surface CD of the special-shaped surface inner cavity through the columnar surface 30 of the rotor body 5, the upper end surface 23 of the rotor body 5 is in sliding fit with the upper cover plate 12, the lower end surface 24 of the rotor body 5 is in sliding fit with the lower cover plate 22, the first combined sliding plate and the second combined sliding plate are in sliding fit with the one-quarter circular arc surface AB of the special-shaped surface inner cavity, the first combined sliding plate is in sliding fit with the first guide groove 19 and the second combined sliding plate is in sliding fit with the second guide groove 20 so as to constitute an anti-inside leakage dynamic sealing system.

When the two ends of the first combined sliding plate 6 are positioned in the region of the one-quarter circular arc surface AB and the region of the one-quarter circular arc surface CD respectively, the first diversion hole 15 of the T-shaped sliding plate 32 positioned in the region of the one-quarter circular arc surface CD and the middle diversion hole 17 of the rotor body 5 shall be just positioned in the coaxial positions so as to communicate the two sides of the second guide groove 19; at this time, the end part 29 of the groove-shaped sliding plate 33 positioned in the region of the position-limiting curved surface EA of the second combined sliding plate 7 is kept in contact with the position-limiting curved surface EA under the action of the thrust of the second elastic elements 11. When the two ends of the second combined sliding plate 7 are positioned in the region of the one-quarter circular arc surface AB and the region of the one-quarter circular arc surface CD respectively, the second diversion hole 16 of the groove-shaped sliding plate 33 positioned in the region of the one-quarter circular arc surface CD and the side wing diversion hole 18 of the rotor body 5 shall be just positioned in the coaxial positions so as to communicate the two sides of the first guide groove 19; at this time, the end part 25 of the T-shaped sliding plate 32 positioned in the region of the position-limiting curved surface EA of the first combined sliding plate 6 is kept in contact with the position-limiting curved surface EA under the action of the thrust of the first elastic element 26.

The assembly procedure of the device is as follows:

1. The two T-shaped sliding plates 32 are oppositely inserted into the first guide groove 19. Before the opposite insertion, the first elastic element 26 is firstly arranged between the two T-shaped sliding plates 32. The two T-shaped sliding plates 32 and the first elastic element 26 are assembled together for constituting the first combined sliding plate 6. Then, the two groove-shaped sliding plates 33 are oppositely inserted into the second guide groove 20, before the opposite insertion, the second elastic elements 11 are firstly arranged between the two groove-shaped sliding plates 33. The two groove-shaped sliding plates 33 and the second elastic elements 11 are assembled together for constituting the second combined sliding plate 7. An assembly of the first combined sliding plate 6, the second combined sliding plate 7 and the rotor body constitutes the rotor.

2. The rotor is inserted into the inner cavity of the housing 1 so as to match the columnar surface of the rotor body 5 with the one-quarter circular arc surface CD of the special-shaped surface inner cavity, then the transmission shaft 9 and the centering shaft 10 on the rotor body 5 are respectively matched with the first bearing hole 13 of the upper cover plate 12 and the second bearing hole 14 of the lower cover plate 22, and the upper cover plate 12 and the lower cover plate 22 are respectively fixed on the upper end surface 27 and the lower end surface 28 of the housing 1 through screws so as to form the sealed cavity body.

The requirements on actions of the device are as follows:

When the metering pump with the special-shaped cavity is in operation working state, the rotor can rotate according to the A→B→C→D direction by external rotation force couple through the transmission shaft 9. When the rotor rotates, the one-quarter oval arc surface BC of the special-shaped surface inner cavity can push the first combined sliding plate and the second combined sliding plate to slide crisscross so as to suck in the fluid from the inlet 2 and press out the fluid from the outlet 3. Four standard volumes $V_0$ can be continuously formed in the AB spatial region in the sealed cavity when the rotor rotates every one cycle so as to enable the equal quantity of the fluid flows by the sealed cavity. The permanent magnet element 8 is utilized for emitting a signal of the number N of the rotation cycles of the rotor to the outside of the sealed cavity. The rotation signal of the rotor is utilized and a closed-loop control system can be designed for realizing real-time regulation of the flow rate.

When the metering pump with the special-shaped cavity is in the non-operation working state, if the pressure of the fluid on the outlet side is larger than the pressure of the fluid on the inlet side, the T-shaped sliding plate 32 or the groove-shaped sliding plate 33 which is positioned in the position-limiting curved surface EA and kept in contact with the position-limiting curved surface EA can be blocked by the turning transition surface DE and the rotor cannot perform reversion.

The working principle of the device is as follows:

1. Pumping of the fluid: when the transmission shaft 9 rotates according to the A→B→C→D direction under the drive the action of external force couple, if the upper half part of one of the two combined sliding plates (assuming that the second combined sliding plate 7 is used here) rotates from the A end to the B end along the one-quarter circular arc surface AB, then the upper half part of the other combined sliding plate (the first combined sliding plate 6) rotates from the end point B of the major semi-axis to the end point C of the minor semi-axis along the one-quarter oval arc surface BC. As the rotor in the AB interval is in zero-clearance fit with various relative kinematic pairs of the cavity body theoretically, the negative pressure is formed in the space which becomes large continuously from the point A on the left side of the second combined sliding plate 7 to the second combined sliding plate 7 so as to suck in the fluid from the inlet 2; the negative pressure is also formed in the space which becomes large continuously from the point E at the lower half part of the first combined sliding plate 6 to the first combined sliding plate 6 so as to suck in the fluid from the inlet 2 into the cavity body via the pressure balancing groove 31; at the same time, after the first combined sliding plate 6 is separated from the point B, the diversion groove 4 can communicate the space on the right side of the first combined sliding plate 6 with the outlet 3 so as to press the fluid on the right side of the first combined sliding plate 6 out of the cavity body through the first combined sliding plate 6, referring to FIG. 1(*a*) and (*b*). When the first combined sliding plate 6 rotates to the point AC position and the second combined sliding plate 7 rotates to point BD position, the first combined sliding plate 6 and the second combined sliding plate 7 exchange roles and the above process is repeated. The rotor rotates continuously and the alternate actions are also performed continuously.

2. Metering of the flow rate: as the first combined sliding plate 6 and the second combined sliding plate 7 are vertically cross, when one combined sliding plate (for example, the second combined sliding plate 7) is positioned in the AC position, the other combined sliding plate (the first combined sliding plate 6) is just positioned in the BD position, which is as shown in FIG. 1(*b*). At this time, the spatial region surrounded by the two combined sliding plates and the one-quarter circular arc surface AB of the special-shaped columnar surface inner cavity in the sealed cavity constitutes one standard volume $V_0$. When the rotor rotates every one cycle, four standard volumes ($4V_0$) are formed and the fluid in four standard volumes ($4V_0$) is simultaneously drained from the outlet 3. The AB spatial region constituting the standard volume is a metering space of the metering pump with the special-shaped cavity, and the metering space is also called as a metering room. The volume flow rate V of the fluid conveyed by the device is calculated according to the following formula:

$$V=4NV_0.$$

3. Control of motion of the combined sliding plates: the motion of the combined sliding plates is investigated, the initial position of the first combined sliding plate 6 is set at BD and the initial position of the second combined sliding plate 7 is set at AC. At this time, the right end (the upper end) of the first combined sliding plate 6 is positioned at the boundary between the ¼ circular arc surface AB and the ¼ oval arc surface BC, and the left end (the lower end) of the first combined sliding plate 6 is positioned at the boundary between the ¼ circular arc surface CD and the transition surface DE; and the left end (the upper end) of the second combined sliding plate 7 is positioned at the boundary between the ¼ circular arc surface AB and the position-limiting curved surface EA, and the right end (the lower end) of the second combined sliding plate 7 is positioned at the boundary between the ¼ oval arc surface BC and the ¼ circular arc surface DC, which is as shown in FIG. 1(*b*). When the rotor rotates according to the A→B→C→D direction, the two combined sliding plates rotate accordingly.

During the process that the second combined sliding plate 7 rotates from the AC position to the BD position, namely during the process that the second combined sliding plate 7 rotates 90 degrees and passes through the metering room, the upper end and the lower end of the second combined sliding plate 7 are respectively kept in elastic contact with the ¼ circular arc surface AB and the ¼ circular arc surface CD of the inner cavity, so that the length of the second combined sliding plate 7 is unchanged and can be kept still relative to the rotor body 5. Simultaneously, the right end of the first combined sliding plate 6 rotates from the end point B of the major semi-axis to the end point C of the minor semi-axis along the ¼ oval arc surface BC, and the left end of the first combined sliding plate 6 enters into the region of the position-limiting curved surface EA and rotates from the end point E to the end point A along the position-limiting curved surface EA; after the left end of the first combined sliding plate 6 enters into the region of the position-limiting curved surface EA, the thrust of the first elastic element 26 can increase the length of the first combined sliding plate 6, and the left end of the first combined sliding plate 6 is in contact with the position-limiting curved surface EA; along with the process that the right end of the first combined sliding plate 6 rotates from the end point B of the major semi-axis to the end point C of the minor semi-axis along the ¼ oval arc surface BC, the ¼ oval arc surface BC pushes the first combined sliding plate 6 to slip in the first guide groove 19, the left end of the first combined sliding plate 6 simultaneously slides along the position-limiting curved surface EA till achieving the end point A, and the right end of the first combined sliding plate 6 achieves the end point C of the minor semi-axis of the ¼ oval arc surface BC at this time. When the first combined sliding plate 6 rotates to the AC position and the second combined sliding plate 7 rotates to the BD position, the two combined sliding plates exchange the actions and the above 90-degree rotation process is repeated. After that, the motion of the combined sliding plates periodically repeats the above actions, referring to FIG. 1.

4. Diversion in the Rotor

During the process that the first combined sliding plate 6 rotates from the AC position to the BD position and the second combined sliding plate 7 rotates from the BD position to the AC position and slides to the left in the second guide groove 20, the first diversion hole 15 on the T-shaped sliding plate 32 at the lower part of the first combined sliding plate 6 is positioned in the position which is coaxial with the middle diversion hole 17 on the rotor body 5, and the left cavity part and the right cavity part between the two groove-shaped sliding plates 33 of the second combined sliding plate 7 are communicated. As the second combined sliding plate 7 slides to the left, the volume of the cavity on the left side is increased continuously for forming the negative pressure, and the volume of the cavity on the right side is reduced continuously for forming positive pressure, the fluid in the cavity on the right side flows into the cavity on the left side through the middle diversion hole 17 and the first diversion hole 15, referring to FIG. 2, FIG. 4, FIG. 5 and FIG. 6. Therefore, the middle diversion hole 17 and the first diversion hole 15 can play a role in releasing the pressure so as to enable the rotor to rotate smoothly; at the same time, the diversion holes further has a certain damping role for sliding of the second combined sliding plate 7.

Similarly, during the process that the second combined sliding plate 7 rotates from the AC position to the BD position and the first combined sliding plate 6 rotates from the BD position to the AC position and slides to the left in the first guide groove 19, the second diversion hole 16 on the groove-shaped sliding plate 33 at the lower part of the second combined sliding plate 7 is positioned in the position which is coaxial with the side wing diversion hole 18 on the rotor body, and the left cavity part and the right cavity part between the two T-shaped sliding plates 32 of the first combined sliding plate 6 are communicated. As the volume of the cavity on the right side is increased continuously and the volume of the cavity on the left side is reduced continuously, the fluid in the cavity on the right side can flow into the cavity on the left side through the side wing diversion hole 18 and the second diversion hole 16.

5. Control of the inside leakage of fluid: when the clearance between the rotor in the sealed cavity and the inner wall of the sealed cavity and among all moving parts of the rotor for sliding fit is small enough, the rotor can form the dynamic sealing mechanism in the sealed cavity and the fluid cannot flow from the inlet 2 to the outlet 3 by the clearance leakage way. Actually, the fit clearance among each sliding friction pair cannot be zero, as long as the inside leakage quantity does not exceed the allowable limit and the rotor can operate smoothly, it is considered that that ideal design is achieved.

6. Prevention of sticking of the rotor: when solid particles contained in the fluid enter into the end part regions of the first combined sliding plate 6 or the second combined sliding plate 7 to generate the clamping stagnation effect against the rotation of the rotor, the first elastic element 26 and the second elastic elements 11 can generate compression deformation, the length of the combined sliding plates can be reduced and the rotor can rotate continuously and cannot be stuck.

What is claimed is:

1. A metering pump with a special-shaped cavity comprising a housing (1) with a special-shaped surface inner cavity, an inlet (2) and an outlet (3), an upper cover plate (12) and a lower cover plate (22), wherein the upper cover plate (12) and the lower cover plate (22) are mounted on the two end surfaces of the housing (1), the housing (1), the upper cover plate (12) and the lower cover plate (22) constitute a sealed cavity, a rotor is mounted in the sealed cavity, and the metering pump with the special-shaped cavity is characterized in that a first combined sliding plate (6) and a second combined sliding plate (7) are arranged on the rotor, and two ends of each of the first combined sliding plate (6) and the second combined sliding plate (7) are kept in joint with the special-shaped surface inner cavity respectively; the special-shaped surface inner cavity of the housing (1) is formed by sequentially linking a one-quarter circular arc surface AB, a one-quarter oval arc surface BC, the one-quarter circular arc surface CD, a turning transition surface DE and a position-limiting curved surface EA, and the one-quarter circular arc surface AB, the one-quarter oval arc surface BC and the one-quarter circular arc surface CD have a common axis O; a radius R of the one-quarter circular arc surface AB is equivalent to a major semi-axis $\alpha$ of the one-quarter oval arc surface BC, and a radius r of the one-quarter circular arc surface CD is equivalent to a minor semi-axis b of the one-quarter oval arc surface BC; the end point B of a major axis of the one-quarter oval arc surface BC is tangent to the one-quarter circular arc surface AB at the end point B for forming a smooth transition; the end point C of a minor axis of the one-quarter oval arc surface BC is tangent to the one-quarter circular arc surface CD at the end point C for forming the smooth transition; the position-limiting curved surface EA is tangent to the one-quarter circular arc surface AB at the end point A for forming the smooth transition; the turning transition surface DE is intersected with the one-quarter circular arc surface CD at the end point D and intersected with the position-limiting curved surface EA at the end point E for forming a step transition from the one-quarter circular arc surface CD to the position-limiting curved surface EA; and a distance from the common axis O is gradually increased during the transition from the E point to the A point in the position-limiting curved surface EA.

2. The metering pump with the special-shaped cavity according to claim 1, characterized in that a length $L_{ce}$ of the line section ce of any straight line which passes the common axis O and is vertical to the common axis O, which is cut by the position-limiting curved surface EA and the one-quarter oval arc surface BC is larger than or equivalent to a sum of the radius R of the one-quarter circular arc surface AB and the radius r of the one-quarter circular arc surface CD.

3. The metering pump with the special-shaped cavity according to claim 1 or 2, characterized in that a distance between the D point and the E point in the turning transition surface DE is larger than or equivalent to zero.

4. The metering pump with the special-shaped cavity according to claim 1, characterized in that the inlet (2) on the housing (1) is formed in the region of the position-limiting curved surface EA and the outlet (3) is formed in the region of the one-quarter oval arc surface BC; and a diversion groove (4) is formed in the region of the one-quarter oval arc surface BC in the circumferential direction, the diversion groove (4) is started from the end point B of the major axis of the oval arc surface BC, stopped at the end point C of the minor axis of the oval arc surface BC and intersected with the outlet (3).

5. The metering pump with the special-shaped cavity according to claim 1 or 2 or 4, characterized in that a pressure balancing groove (31) is formed in the region of the position-limiting curved surface EA in the circumferential direction, and the pressure balancing groove (31) is started at the inlet (2) and stopped at the end point E of the transition surface DE.

6. The metering pump with the special-shaped cavity according to claim 1, characterized in that the rotor further comprises a rotor body (5), the rotor body (5) is a column body, a first guide groove (19) and a second guide groove (20), which are crisscross, are radially formed on the rotor body (5), and the first combined sliding plate (6) and the second combined sliding plate (7) are arranged in the first guide groove (19) and the second guide groove (20) respectively in a slidable manner.

7. The metering pump with the special-shaped cavity according to claim 6, characterized in that an axial line of the rotor body (5) is in superposition with the common axis O.

8. The metering pump with the special-shaped cavity according to claim 6 or 7, characterized in that a radius $R_1$ of the rotor body (5) is equivalent to the radius r of the one-quarter circular arc surface CD.

9. The metering pump with the special-shaped cavity according to claim 6 or 7, characterized in that a height of each of the rotor body, the first combined sliding plate (6) and the second combined sliding plate (7) is consistent with that of the special-shaped surface inner cavity.

10. The metering pump with the special-shaped cavity according to claim 6 or 7, characterized in that the first guide groove (19) and the second guide groove (20) are in centrosymmetric structures, two wings of each guide groove are incised into the rotor body (5) by a certain depth along the radial direction of the rotor body (5) forming incision sections in the two wings of each guide groove, the incision sections being simultaneously through along the axial line of the rotor body (5), a radially through rectangular hole is arranged at the middle part of the first guide groove (19), the second guide groove (20) is incised into the rotor body (5) along the axial line direction of the rotor body (5) from an upper end surface (23) and a lower end surface (24) of the rotor body (5) respectively forming incision parts in the second guide groove (20), the incision parts being simultaneously through along the radial direction of the rotor body (5), and the two guide grooves are mutually separated at the intersection.

11. The metering pump with the special-shaped cavity according to claim 10, characterized in that the first combined sliding plate (6) is formed by combining two T-shaped sliding plates (32) in the same structure and a first elastic element (26), the bottom parts of the two T-shaped sliding plates (32) are opposite to each other, the bottom parts of the two T-shaped sliding plates are connected through the first elastic element, and the bottom parts of the T-shaped sliding plates (32) are matched with the rectangular hole at the middle part of the first guide groove (19); and the second combined sliding plate (7) is formed by combining two groove-shaped sliding plates (33) and two second elastic elements (11), wherein a groove is formed on one side edge of each groove-shaped sliding plate (33), two groove legs are formed at two ends on the groove-forming side of each groove-shaped sliding plate (33), the two groove-shaped sliding plates (33) are in the same structure, the groove legs are opposite mutually and connected through the second elastic elements (11), and the groove legs are matched with the middle part of the second guide groove (20).

12. The metering pump with the special-shaped cavity according to claim 11, characterized in that a length $L_1$ of the T-shaped sliding plates (32), a length $L_2$ of the groove-shaped sliding plates (33), the radius R of the one-quarter circular arc surface AB and the radius r of the one-quarter circular arc surface CD meet the relationships that $2L_1 \leq R+r$, $2L_2 \leq R+r$.

13. The metering pump with the special-shaped cavity according to claim 11, characterized in that a middle diversion hole (17) which is vertical to the axial line of the rotor body (5) and parallel to the second guide groove (20) is arranged on the side wall of the rectangular hole at the middle part of the first guide groove (19), and when the first combined sliding plate (6) moves from the AC position to the BD position and the second combined sliding plate (7) moves from the BD position to the AC position, the first diversion hole (15) on the T-shaped sliding plate (32) that contact with the one-quarter circular arc surface CD is positioned in the position which is coaxial with the middle diversion hole (17) on the rotor body (5), and the left cavity part and the right cavity part between the two groove-shaped sliding plates (33) of the second combined sliding plate (7) are communicated;

two side wing diversion holes (18) which are vertical to the axial line of the rotor body (5) and parallel to the first guide groove (19) are arranged on the side walls of upper and lower incision sections at the middle part of the second guide groove (20) respectively, and when the second combined sliding plate (7) moves from the AC position to the BD position and the first combined sliding plate (6) moves from the BD position to the AC position, the two second diversion holes (16) on the groove-shaped sliding plate (33) that contact with the one-quarter circular arc surface CD are positioned in the position which are coaxial with the middle diversion holes (18) on the rotor body (5), and the left cavity part and the right cavity part between the two T-shaped sliding plates (32) of the first combined sliding plate (6) are communicated; and first diversion holes (15) are arranged at the bottom parts of the T-shaped sliding plates (32), the distance between each first diversion hole (15) and the outer side edge of the corresponding T-shaped sliding plate (32) is consistent with the radius of the rotor body (5), the height of the first diversion holes (15) is consistent with that of the middle diversion hole (17), second diversion holes (16) are arranged at the two groove legs of each groove-shaped sliding plate (33) respectively, the distance between each second diversion hole (16) and the outer side edge of the corresponding groove-shaped sliding plate (33) is consistent with the radius of the rotor body (5), and the heights of the two second diversion holes (15) are consistent with the heights of the two side wing diversion holes (18) respectively.

14. The metering pump with the special-shaped cavity according to claim 1 or 2 or 4 or 6 or 7, characterized in that a countersunk hole (21) is processed on the upper end surface (23) of the rotor body (5) and a permanent magnet element (8) is arranged in the countersunk hole.

15. The metering pump with the special-shaped cavity according to claim 14, characterized in that the upper cover plate (12) adopts non-ferromagnetic material.

16. The metering pump with the special-shaped cavity according to claim 1 or 2 or 4 or 6 or 7, characterized in that the upper cover plate (12) and the lower cover plate (22) are flat plates, a first bearing hole (13) is processed at the center of the upper cover plate (12), a second bearing hole (14) is processed at the center of the lower cover plate (22), the first bearing hole (13) is a through hole, the second bearing hole (14) is a blind hole, a transmission shaft (9) matched with the first bearing hole (13) is arranged at the upper end of the rotor, and a centering shaft (10) matched with the second bearing hole (14) is arranged at the lower end of the rotor.

17. The metering pump with the special-shaped cavity according to claim 1 or 6, characterized in that a middle diversion hole (17) which is vertical to the axial line of the rotor body (5) and parallel to the second guide groove (20) is arranged on the side wall of the rectangular hole at the middle part of the first guide groove (19), and when the first combined sliding plate (6) moves from the AC position to the BD position and the second combined sliding plate (7) moves from the BD position to the AC position, the first diversion hole (15) on the T-shaped sliding plate (32) that contact with the one-quarter circular arc surface CD is positioned in the position which is coaxial with the middle diversion hole (17) on the rotor body (5), and the left cavity part and the right cavity part between the two groove-shaped sliding plates (33) of the second combined sliding plate (7) are communicated;

two side wing diversion holes (18) which are vertical to the axial line of the rotor body (5) and parallel to the first guide groove (19) are arranged on the side walls of upper and lower incision sections at the middle part of the second guide groove (20) respectively, and when the second combined sliding plate (7) moves from the AC position to the BD position and the first combined sliding plate (6) moves from the BD position to the AC position, the two second diversion holes (16) on the groove-shaped sliding plate (33) that contact with the one-quarter circular arc surface CD are positioned in the position which are coaxial with the middle diversion holes (18) on the rotor body (5), and the left cavity part and the right cavity part between the two T-shaped sliding plates (32) of the first combined sliding plate (6) are communicated; and first diversion holes (15) are arranged at the bottom parts of the T-shaped sliding plates (32), the distance between each first diversion hole (15) and the outer side edge of the corresponding T-shaped sliding plate (32) is consistent with the radius of the rotor body (5), the height of the first diversion holes (15) is consistent with that of the middle diversion hole (17), second diversion holes (16) are arranged at the two groove legs of each groove-shaped sliding plate (33) respectively, the distance between each second diversion hole (16) and the outer side edge of the corresponding groove-shaped sliding plate (33) is consistent with the radius of the rotor body (5), and the heights of the two second diversion holes (15) are consistent with the heights of the two side wing diversion holes (18) respectively.

* * * * *